United States Patent [19]

Christiani

[11] 4,380,157

[45] Apr. 19, 1983

[54] SELF-CHILLING DISPENSER FOR DRINKING FLUIDS

[76] Inventor: Peter Christiani, 333 First St., Apt. D-303, Seal Beach, Calif. 90740

[21] Appl. No.: 281,366

[22] Filed: Jul. 8, 1981

[51] Int. Cl.[3] ..... F28C 1/00

[52] U.S. Cl. ..... 62/315; 62/371; 62/457; 215/13 R; 312/31.04

[58] Field of Search ..... 215/13 R; 312/31.04; 261/94; 62/315, 457, 371

[56] References Cited

U.S. PATENT DOCUMENTS

| | | | |
|---|---|---|---|
| 103,473 | 5/1870 | Klee et al. | 312/31.04 |
| 539,727 | 5/1895 | Cutler | 312/31.04 |
| 1,017,217 | 2/1912 | Jones | 62/315 X |
| 1,410,365 | 3/1922 | Brown | 312/31.04 |
| 4,037,428 | 7/1977 | Giannotti | 62/457 X |
| 4,351,164 | 9/1982 | Christiani | 62/315 |

*Primary Examiner*—Lloyd L. King

*Attorney, Agent, or Firm*—William H. Pavitt, Jr.

[57] ABSTRACT

An evaporative self-chilling dispensing container for potable liquids has a wall of porous material immersible in a coolant fluid defining an inner wall surface, an outer wall surface, and a generally transverse lip surface joining the inner and outer surfaces. The inner wall surface defines a cavity for receiving a potable liquid and a mouth opening rimmed by the lip surface. A thin impermeable layer fully lines the interior wall surface and extends uninterruptedly outwardly over the lip surface to prevent intermixing of the coolant fluid with the potable liquid during storage and also while said potable liquid is poured from the container.

1 Claim, 3 Drawing Figures

SELF-CHILLING DISPENSER FOR DRINKING FLUIDS

BACKGROUND OF THE INVENTION

1. Field of the Invention

This invention is directed to a dispensing container for drinking fluids and is more particularly directed to a self-chilling dispenser of the evaporative cooler type for drinking fluids.

2. State of the Prior Art

The principle of cooling foods by storing the same in containers of a porous material which could be soaked in water is well known in the art, and is exemplified by such patents as U.S. Pat. No. 1,017,217 issued to Jones on Feb. 13, 1912 for a refrigerating device made of plaster of Paris or a similar material capable of absorbing a large quantity of water. The water is then allowed to evaporate, e.g., at room temperature, to extract heat from the interior of the container and thus cool foods stored therein. Similar devices are disclosed by U.S. Pat. No. 539,727 issued May 21, 1885 to Cutler and U.S. Pat. No. 103,473 issued May 24, 1870 to Klee et al. for a butter dish. The latter reference includes a bottom dish for supporting the butter and a cover made of a porous or absorbent material such as porous clay, adapted to sit in an annular trough or recess in the lower vessel. The interior of the cover is glazed to prevent water from dripping onto the butter or other contents of the bottom dish. Water is placed in a receptacle provided at the crown of the cover portion, which water then flows downwardly through the porous material of the cover and eventually is received in the trough of the bottom dish. This bottom dish evidently is of an impermeable material so that the water collects in the trough.

While the above disclosures teach various refrigerating enclosures for the storage of foods, none of them teaches or suggests the use of such devices for the direct evaporative cooling of potable liquids stored within a unitary vessel. This is clearly impractical in the dishes disclosed if the teachings of the cited references are followed since any such liquid would be immediately absorbed by the porous material of the vessel itself. It would also be diluted by the water permeating the porous walls.

Recently, there has appeared on the commercial and consumer marketplace a solution to the above problem, wherein a cylinder of porous material operates as an evaporative cooler and defines a cylindrical cavity adapted to receive a bottle, such as a bottle of wine, which is placed therein and is cooled by the evaporative action of the earthenware vessel. The wine or other drinking liquid is contained within its own, separate bottle of glass or other impermeable material.

SUMMARY OF THE INVENTION

The prior art does not provide a satisfactory solution to the problem of chilling potable liquids in a practical and convenient manner using the principle of evaporative cooling. The vessels of the prior art cannot be used directly for holding such liquids and the use of a separate container reduces the efficiency of the cooling effect by increasing the thermal mass to be cooled as well as placing a thermal barrier between the refrigerant vessel and the liquid. Further, it is inconvenient to pour liquid from the inner container while still within the outer earthenware cylinder and thus, the inner container is generally removed for dispensing the liquid which intermittently interrupts the chilling process. Additionally the possibility is introduced that the bottle may be placed on the table through forgetfulness without being replaced into the chilling outer container.

The present invention overcomes these and other drawbacks of the prior art by providing a self-chilling dispensing container for potable liquids which may be of low cost unitary construction and of practically any desired shape.

In a preferred embodiment, the invention is a container, including a wall of porous material having an interior wall surface which defines a cavity with an upper mouth opening for receiving the potable liquid, and an exterior wall surface immersible in a coolant fluid which is absorbed and retained within the porous wall. When the container is thereafter exposed to the atmosphere, the coolant liquid evaporates at room temperature, aided by existing air currents or drafts to thus chill the potable liquid. The container also includes a lip surface which connects the interior wall and the exterior wall to define a rim about the mouth opening. A thin non-porous layer of a material which is substantially insoluble in either the potable fluid or the coolant fluid is formed to fully line the interior wall surface and is formed intergral therewith to form an impermeable boundary between the potable liquid and the coolant fluid, so that the former is not contaminated by the latter. An important element of the invention is the uninterrupted extension of the non-porous layer from the inner surface outwardly over the lip surface to further prevent the potable liquid from intermixing with the coolant fluid when the potable fluid is poured from the dispensing container.

It is thus seen that the novel self-chilling dispenser of this invention overcomes the shortcomings of the prior art to extend the advantages of natural energy-saving evaporative cooling to unitary containers for drinking fluids without necessity of an additional and separate inner container.

DETAILED DESCRIPTION OF THE INVENTION

Figure 1:
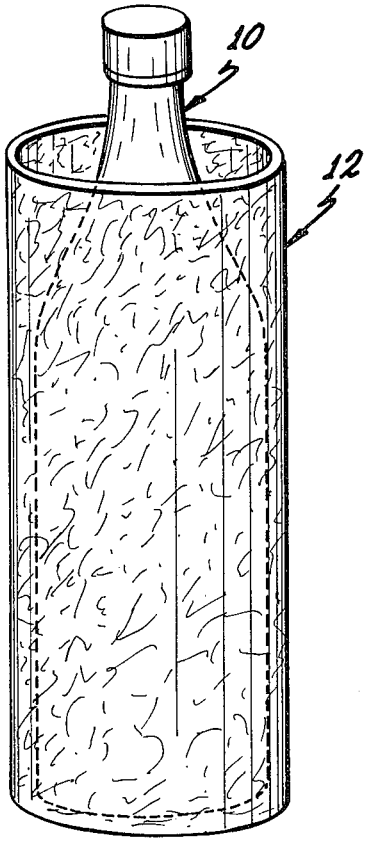
FIG. 1 PRIOR ART
FIG. 1 is a perspective view of the prior art showing a bottle in a cylindrical outer jacket of porous material.

FIG. 1 illustrates the known prior art, wherein a conventional bottle 10 made of glass or other impermeable material is set within a closely fitting outer cylindrical jacket 12 made of a porous absorbent material such as a porous clay. The cylinder 12 is immersible in water such that the porous material becomes saturated and when left exposed to the atmosphere at room temperature thereafter the steady evaporation of the water from the porous cylinder 12 works to cool the bottle 10 and the contents thereof by well-known physical principles.

Clearly the prior art does not represent an ideal solution in that it is quite awkward to pour liquid from the bottle 10 without first removing the bottle from within the refrigerating cylinder 12. Upon doing so, the cooling process is interrupted, and the bottle begins to warm to room temperature, in addition, the repeated return of the bottle 10 to the interior of the cylinder 12 becomes a nuisance and it is probable that sooner or later the bottle will be simply placed on the table.

Figure 2:
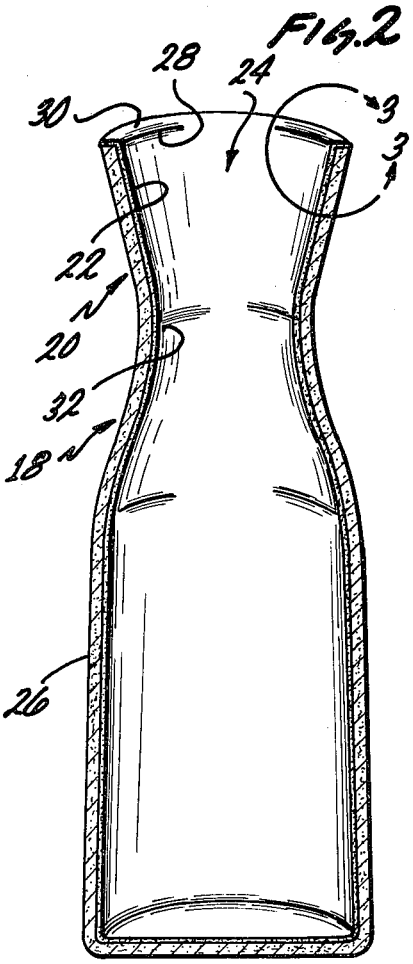
FIG. 2 is an elevational section of a container according to this invention; and, FIG. 3 is an enlarged view of the lip portion of the vessel of FIG. 2.

The improved self-chilling dispensing container of this invention is shown in FIG. 2. The particular embodiment illustrated is a wine flask or flagon of classical design and unitary construction. The container has a wall 20 of a porous material such as clay. The wall 20 has an inner wall surface or side 22 which defines a cavity 24 for receiving a potable liquid such as wine. The wall 20 also has an outer wall surface 26. The interior cavity 24 is open at an upper mouth opening 28. A generally planar rim surface 30 is generally horizontal and transversely disposed to the upwardly extending inner and outer wall surfaces 22 and 26 respectively, thus defining a circular rim about the mouth opening 28.

The interior wall surface 22 is fully treated with a substance which is substantially insoluble in either the potable liquid to be stored within the container or in the coolant fluid to be absorbed by the porous material of wall 20. The treatment may consist of a glazing layer which is applied to the clay prior to firing of the container 18. The resultant insoluble layer forms an impermeable lining 32 fully covering the interior wall surface 22 to thereby form a boundary between the potable liquid within the cavity 24 and the coolant liquid permeating the wall 20, thereby preventing contaimination of the former by the latter.

The impermeable boundary 32 should be of small thickness relative to the thickness of the porous wall 20. The impermeable layer 32 is desirably as thin as possible in order to minimize the thermal resistance that it interposes between the exterior coolant wall 20 and the liquid stored within the container, while simultaneously minimizing the thermal mass of non-porous wall material which is not operative for cooling the contents.

Fired clay is a rather brittle material and when used in a dispensing container care should be taken that the lip of the vessel does not chip by hitting the lip against other vessels while the potable liquid is being dispensed, or during washing of the vessel.

Figure 3:
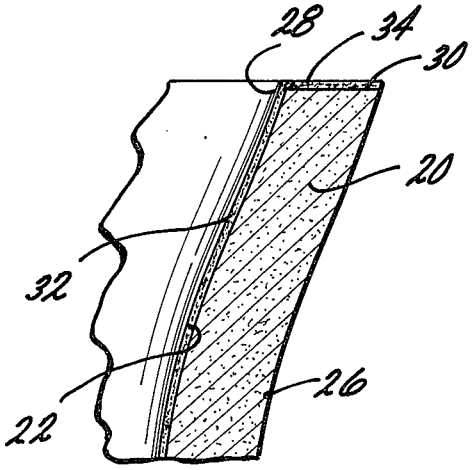

This difficulty is resolved in the present invention by providing the aforedescribed rim surface extending between the inner and outer wall surfaces such that the wall 20 terminates undiminished in thickness at the mouth opening 28 in a blunt rim surface to minimize the likelihood of chipping. Of importance to the proper operation of the novel container is the uninterrupted extension of the impermeable boundary layer or lining 32 from the interior wall surface 22 outwardly over the lip or rim surface 30 in an annular impermeable layer 34 shown in cross section in FIG. 3. The impermeable layer 32 is extended in an uninterrupted fashion from the interior lining outwardly over this blunt rim or end surface 30 to prevent intermixing of the decanted potable liquid with the coolant liquid saturating the porous wall 20.

While a preferred embodiment of the invention has been described for purposes of illustration, it will be understood that various changes and substitutions may be made by those skilled in the art without departing from the scope of the invention which is defined solely by the following claims.

What is claimed is:

1. A self-chilling dispensing container for potable fluids comprising:

a wall of porous material, said wall having an interior wall surface defining a cavity and an upper mouth opening for receiving a potable liquid, and an exterior wall surface immersible in a coolant fluid such that said coolant fluid is absorbed and retained within said wall and thereafter may be allowed to evaporate to thus chill said potable liquid, there being a lip surface connecting said interior wall surface and said exterior wall surface to define a rim about said mouth, and a nonporous layer substantially insoluble in either fluid fully lining said interior wall surface and integral therewith forming an impermeable boundary between said potable liquid and said coolant fluid whereby the former is not contaminated by the latter, said nonporous layer extending uninterruptedly from said inner surface outwardly over said lip surface to further prevent said potable liquid from intermixing with said coolant fluid during decanting of said potable fluid from said container.

* * * * *